United States Patent [19]

Blair et al.

[11] 4,367,865

[45] Jan. 11, 1983

[54] METHOD AND APPARATUS FOR EMPTYING BOTTLE CARS

[75] Inventors: Matthew J. Blair, Niles; George E. Keifer, Jr., Warren, both of Ohio

[73] Assignee: Republic Steel Corporation, Cleveland, Ohio

[21] Appl. No.: 304,198

[22] Filed: Sep. 21, 1981

[51] Int. Cl.[3] ..... F27D 3/14

[52] U.S. Cl. ..... 266/44; 266/143; 266/165; 266/240

[58] Field of Search ..... 104/48; 222/165, 590, 222/591, 604; 266/44, 165, 142, 143, 158, 236, 238, 240, 246

[56] References Cited

U.S. PATENT DOCUMENTS

| | | | |
|---|---|---|---|
| 517,134 | 3/1894 | Worthen | 104/34 |
| 671,025 | 4/1901 | Martin | 414/362 |
| 3,013,789 | 12/1961 | Sayre et al. | 266/143 |
| 3,141,916 | 7/1964 | McFeaters et al. | 266/142 |
| 3,285,441 | 11/1966 | Kersey et al. | 414/362 |
| 3,604,697 | 9/1971 | Kawana et al. | 266/158 |
| 3,746,325 | 7/1973 | Freeberg et al. | 104/48 X |

*Primary Examiner*—L. Dewayne Rutledge
*Assistant Examiner*—David A. Hey
*Attorney, Agent, or Firm*—Watts, Hoffmann, Fisher & Heinke Co.

[57] ABSTRACT

Method and apparatus for emptying bottle cars 22 of hot metal and slag. A rotatable bottle 24 is mounted to a railroad car for movement of molten iron between a blast furnace and a steel making facility such as a basic oxygen furnace or the like. To facilitate emptying the bottle, a section 32 of railroad track, shorter than the length between the wheels of the car, is moved transversely from beneath the bottle to one side of the car and the bottle rotated as much as 180° to pour contents of the bottle from a central opening into a receiving ladle 14 below the track. The path of the contents passes through the area from which the track section was removed. Stops 50 prevent movement of the bottle car after the section has been moved.

14 Claims, 4 Drawing Figures

METHOD AND APPARATUS FOR EMPTYING BOTTLE CARS

TECHNICAL FIELD

This invention relates generally to the transfer of molten metals and more particularly relates to the transfer of molten iron in bottle cars and the dekishing of the cars during use in a steel-making process.

BACKGROUND ART

In the manufacture of steel, iron from blast furnaces is transported to steel making furnaces, commonly in so-called "bottle cars," which are railroad cars with specially constructed containers for holding molten metal. The railroad car carries an oval-shaped container called a "bottle" mounted for rotation about an axis parallel to the railroad car length. The bottle includes an opening in the top for receiving and dispensing the molten iron. To dispense or unload the iron, the bottle is rotated about its axis of rotation and the molten iron is poured into a receiving ladle that is then taken to a steel-making furnace. This dispensing or unloading takes place at a receiving station, where a railroad track extends over a pit in which the receiving ladle is located at a level beneath the track.

After the iron has been poured from the bottle car, a so-called "slag ladle" or "slag pot" is positioned in the pit adjacent the railroad car. The bottle is again rotated and slag material, which had been retained in the bottle when the iron was poured, is poured into the slag ladle. An alternative method for removing slag from the bottle is to rotate the bottle in an opposite direction about its axis away from the receiving ladle and dump the slag material into an area of the pit adjacent the iron-receiving ladle, and periodically cleaning the area. Another prior art technique involves pouring molten iron from the bottle at a receiving station and then transferring the bottle car to a slag pit for pouring off the slag that remains in the bottle car.

The prior art methods of removing molten iron from railroad bottle cars are unsatisfactory for several reasons. Due to the construction and arrangement of the railroad bottle car and the railroad tracks, a certain amount of molten iron is wasted in the sense of either being discarded or recycled. This is because it is necessary to rotate the bottle container substantialy 180° from its original upright position to completely empty the bottle of molten iron. If the bottle is rotated to this extent, however, the railroad track above the receiving ladle is in the path of the flow and is contacted by the molten iron with resulting splashing and damage to the track. To avoid that, the bottles are rotated less than 180° to keep the flow from the bottle opening to one side of the track. This prevents complete emptying and a certain amount of remaining iron is then lost, i.e., disposed of with the slag or returned with the car for refilling. Moreover, when it comes to removing the slag, the tracks over the slag pit or slag ladle are in the path of flow and become damaged by the slag and remaining iron emptied from the bottle. At regular intervals, slag and residual iron that is merely dumped in a pit must be removed at considerable expenditure of labor and equipment.

DISCLOSURE OF INVENTION

The present invention provides method and apparatus for overcoming the disadvantageous features of prior art molten metal unloading techniques. Practice of the invention results in an increase in the amount of usable metal that can be unloaded from a bottle car and hence reduces the amount that remains with the slag or kish material, which must be disposed of or returned with the car to the blast furnace. Utilization of structure embodying the present invention allows a metal-containing bottle to be rotated 180° about its horizontal axis, from an upright to a fully inverted position if desired, without damage to supporting track. Such rotation insures all usable iron is deposited in the receiving ladle.

The preferred method of transferring molten iron advantageously employs a movable section of railroad track. A bottle-carrying railroad car is moved along a supporting track until it is positioned over a ladle station. A portion or section of track beneath the bottle and between the car trucks is removed and the bottle is rotated about an axis parallel to the track to pour molten metal into a receiving ladle below the car. Since the track directly beneath the bottle has been removed, the bottle can be rotated a full 180° if desired, without having the flow of iron intercepted by the track, with accompanying splashing and track damage. Substantially all usable iron can be transferred to the receiving ladle as it is decanted from the bottle, leaving substantially only the slag. Any small amount of iron left in the bottle will be poured into a slag ladle when the car is dekished, i.e., emptied of slag and dross.

When the section of railroad track has been removed, rolling of the bottle car along the track in either direction is prevented by blocks or rail stops positioned along the track adjacent the gap. These stops are raised before the section is removed to prevent movement of the car into the gap.

During an unloading operation, the removable section is first moved sideways and the molten iron is then poured from the bottle to the side of the car opposite from that to which the track was moved, into a receiving ladle. Once the ladle is full, the bottle is rotated to its upright position and the receiving ladle is removed. If usable iron remains in the bottle another receiving ladle may be positioned under the bottle. Once all usable iron has been removed a slag ladle or pot is positioned under the car and the bottle is dekished, i.e., again rotated to remove all slag material from the car. Because the bottle can be rotated a full 180° if desired, all usable molten iron can be poured before dekishing.

According to an alternate embodiment of the invention, the track section beneath the car can be moved in either of two opposite lateral directions. The usable metal is poured to one side of the car opposite the side to which the track is moved, then the track is moved through its original position to the other side of the car and the slag is poured into a slag pot on the opposite side. The ability to drain material from both sides of the car provides added flexibility that allows all designs of hot metal bottles to be used.

Practice of the invention results in a considerable reduction in waste and pollution. All usable molten iron can now be poured into the receiving ladle whereas prior art systems resulted in a significant portion of usable metal being lost with the slag. Also, the metal pouring and dekishing can be done at the one station, where a fume control exhaust system can be provided to reduce emissions during both operations. In the event unwanted slag is charged into the receiving ladle during the pouring, known techniques employed at later steps of the steel making process can remove the slag. In particular, a slag dam receiving ladle can be used or slag raking devices known in the art may be used to remove slag from the receiving ladle.

From the above, it is seen that the invention reduces waste and pollution, eliminates track damage, and avoids the need for a separate station for dekishing, all of which have been associated with prior art pouring and dekishing processes. Other features of the invention will be apparent from the preferred embodiment described below in conjunction with the accompanying drawings.

BEST MODE FOR CARRYING OUT THE INVENTION

Figure 1:
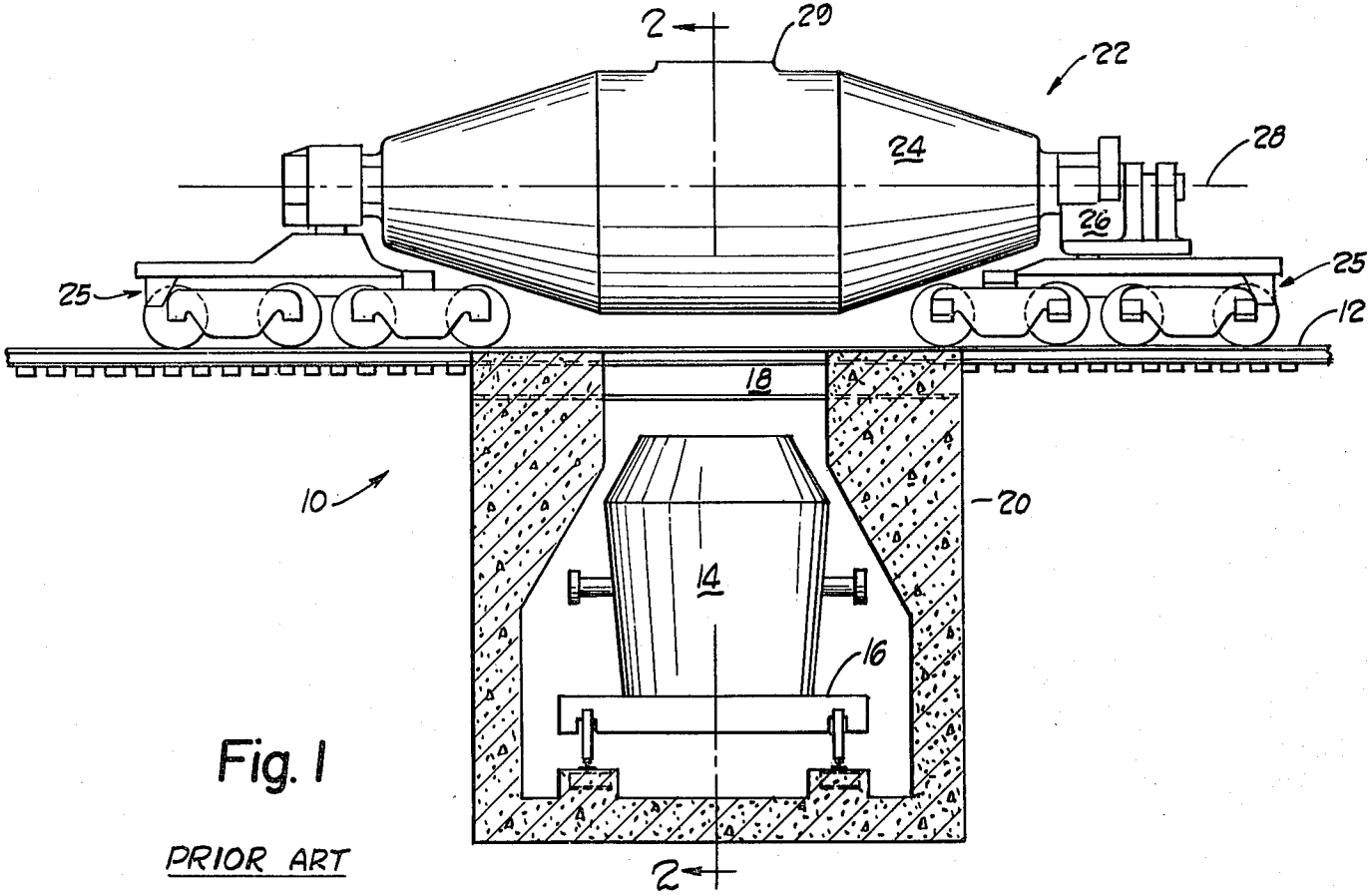
Fig. 1 PRIOR ART
FIG. 1 shows a side elevational view of a prior art dekishing station.
Figure 2:
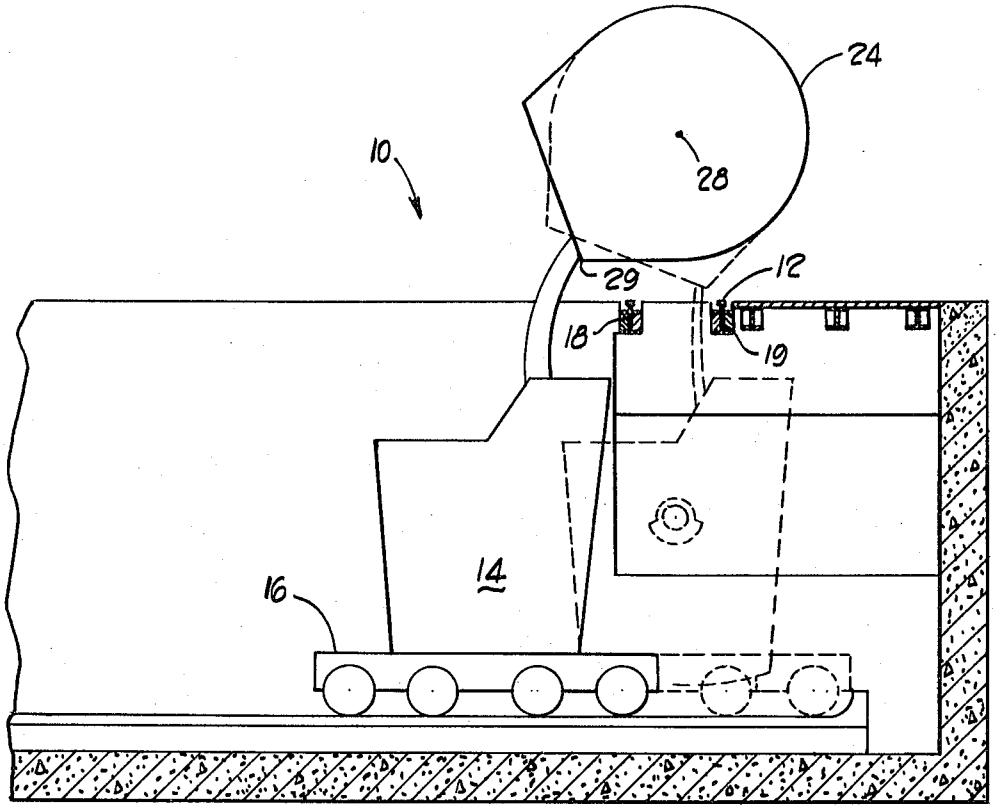
Fig. 2 PRIOR ART
FIG. 2 shows a sectional view as seen from the plane defined by the line 2—2 in FIG. 1.

Turning now the the drawings, a prior art hot metal pouring station 10 is shown in FIGS. 1 and 2. That station 10 includes a permanently positioned railroad track 12 mounted above a receiving ladle 14 which in turn is located on a movable platform car 16. The track 12 is supported above the ladle by two track girders 18, 19 embedded in concrete walls 20 of the pouring station 10.

A hot metal bottle car 22 is positioned on the track above the ladle. The bottle car 22 is of conventional and known design and may, for example, be obtained from the William B. Pollock Company of Youngstown, Ohio. The bottle car comprises a rotatably mounted bottle 24 supported on tracks 25 and coupled to an electric motor 26 for rotation about a horizontal longitudinal axis 28. Controlled activation of the motor 26 causes the bottle 24 to rotate about the axis 28 and pour molten metal from a spout 29.

FIG. 2 illustrates the inefficiencies of the prior art pouring station. With the receiving ladle 14 in a first position (solid line), beneath yet to the side of the track 12, the bottle 24 is rotated less than 180° to pour molten metal from the spout 29 into the receiving ladle 14. This results in usable metal remaining in the bottle. If all the metal is to be poured, the bottle 24 must be rotated substantially a full 180° into an upside down position and the receiving ladle 14 must be moved during the pouring to a second position (shown in phantom) directly beneath the railroad track 12. However, during this procedure, hot metal pours from the bottle onto the railroad track with resultant splash and damage to the track, which in turn necessitates expensive and time delaying maintenance procedures.

Figure 3:
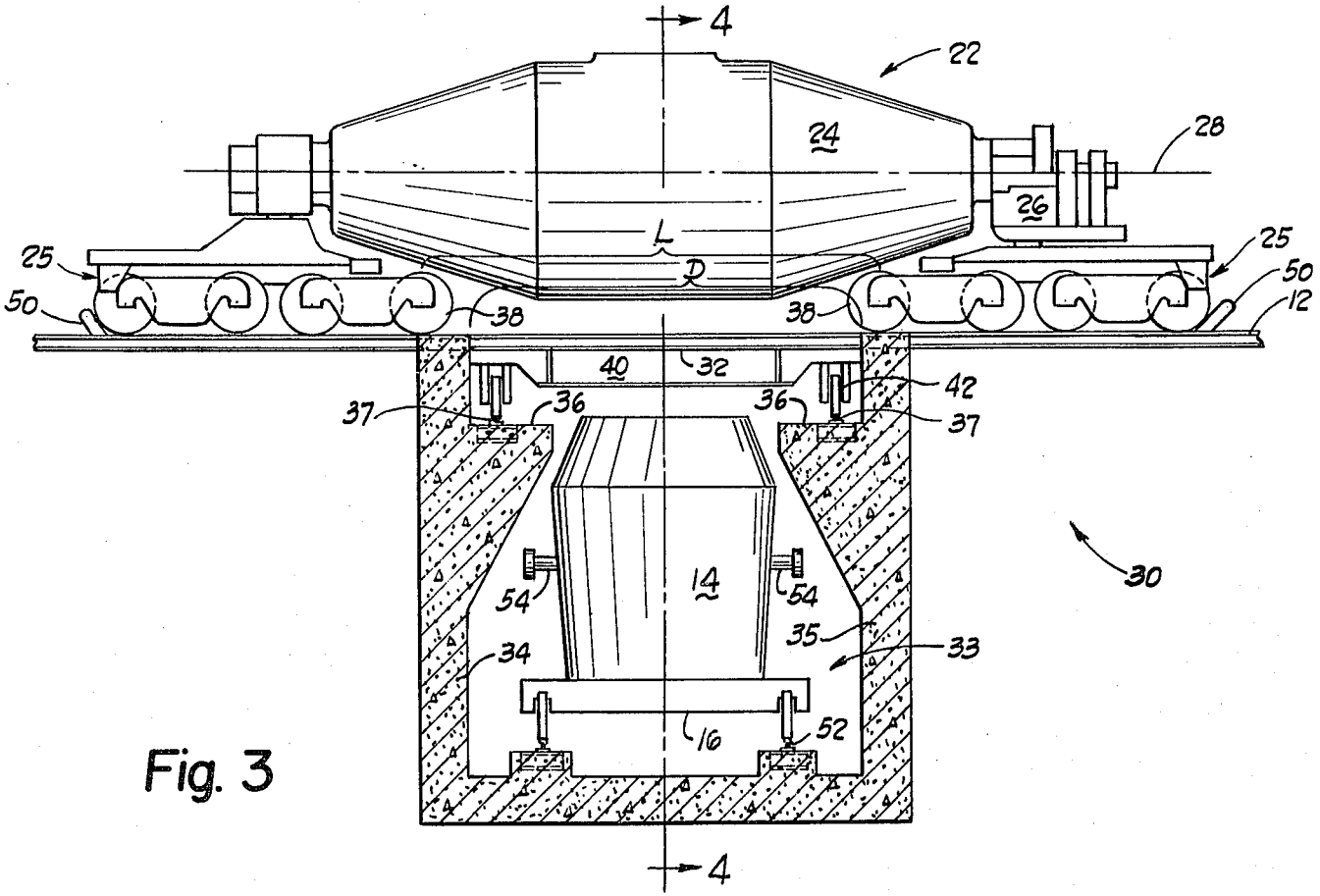
FIG. 3 shows a side elevational view of a dekishing station embodying the present invention.
Figure 4:
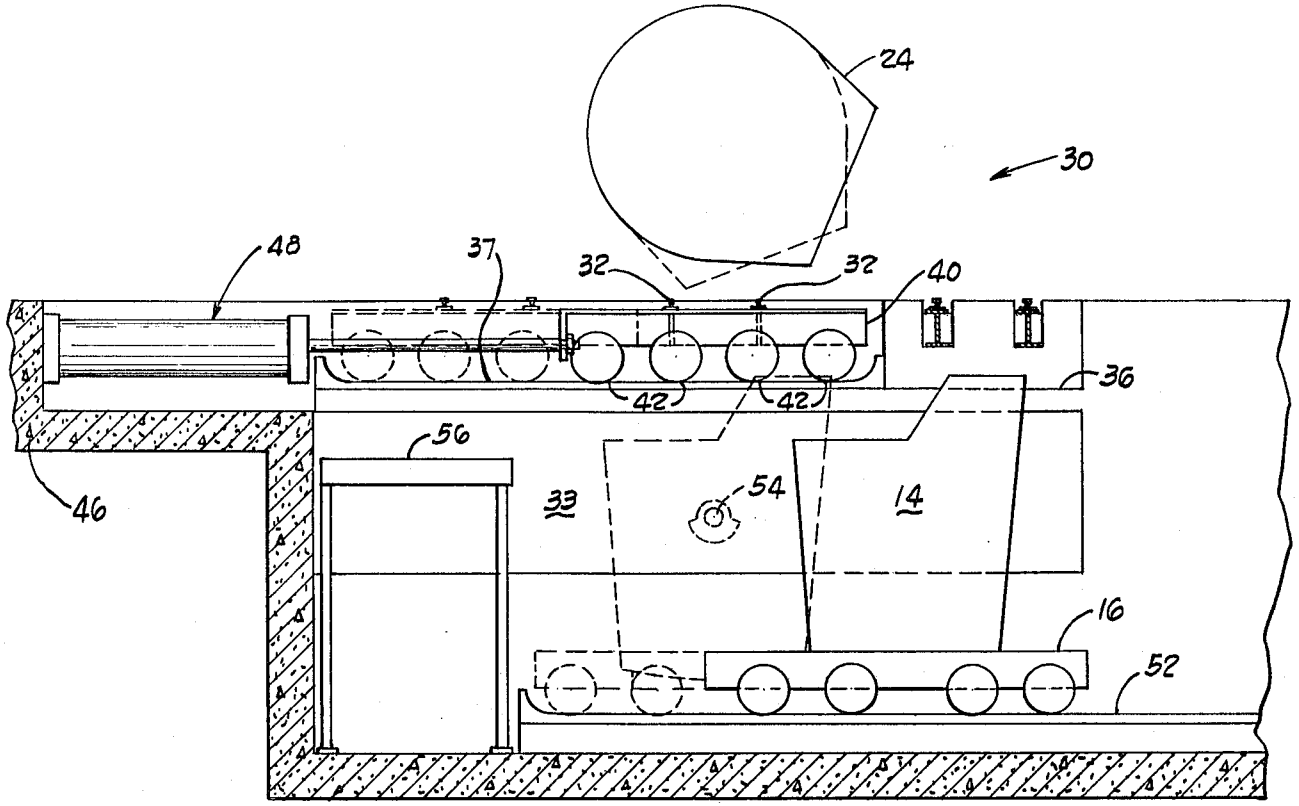
FIG. 4 shows a sectional view taken along the line 4—4 of FIG. 3.

FIGS. 3 and 4 illustrate an improved pouring and dekishing station 30 constructed in accordance with the present invention and associated with the bottle car 22. The station 30 has a section 32 of the railroad track 12 movably mounted above a receiving pit 33. The pit 33 is in part formed by two concrete walls 34, 35 of slightly different construction than in the prior art. The walls 34, 35 each define a recessed horizontal ledge 36 beneath and extending transversely of the railroad track 12 on either side of the pit 33. The ledges support the movable track section 32. A pair of permanently installed stationary railroad track sections 37 extend along the ledges transversely of the track 12 away from the station 30 and allow the section 32 to be moved laterally from beneath the bottle car 22. Before a bottle car 22 is rolled into position above the receiving pit, the movable track section 32 is aligned with the track 12 and spans the gap between the wall structures 34, 35, abutting at opposite ends with the fixed track 12. A distance D is provided between the walls 34, 35, equal to the length of the movable track section 32. This distance is less than the length L between inner bottle car wheels 38, which allows the movable track section 32 to be moved along the track sections 37 from beneath the bottle car 22 after the car is in the position shown in FIG. 3 and before the bottle 24 is rotated about its axis 28. When the car is positioned as shown, the opening 29 is aligned, in the longitudinal direction of the track, with the ladle 14.

The movable section 32 is mounted to a platform 40 supported by wheels 42, which roll upon the rail sections 37 fixed to the ledges 36. In the preferred embodiment of the invention the platform 40 is coupled to an end wall 46 (FIG. 4) of the pit 33 by a double acting hydraulic actuator 48 for reciprocating the platform 40 horizontally along the rail sections 37. Although the disclosed actuator comprises a double acting hydraulic cylinder, other mechanisms for moving the platform could be utilized, such as an electrically operated gear driven mechanism. A shown in FIG. 4, the removal of the track section 32 from the solid line location directly beneath the bottle 24 to the phantom location offset to the side of the car opposite from the pouring side, enables the bottle 24 to be rotated a full 180° about its horizontal axis 28 to dispense all usable hot metal from the bottle without interference from or damage to the railroad track 12 or the section 32.

As seen in FIG. 3, two car stops 50 are positioned along the track 12 on both sides of the pit 33. These stops are selectively movable from a retracted position in which they allow a car to be moved over the pit, to an extended position shown, in which they contact wheels of the car 22 to prevent movement of the car along the track 12 when the removable track section 32 has been moved to the side. In the embodiment shown, a movable track maintenance platform 56 is provided in the pit 33 to allow maintenance procedures to be performed on the movable track section should a malfunction occur.

In operation, a fully loaded bottle car 22 is moved to a position at the station 30 above the pit 33 with the track section 32 aligned with the track 12. The movable track section 32 is then moved by the actuator 48 to the phantom location in FIG. 4 to allow efficient pouring of the hot metal. When the bottle car is relatively full the receiving ladle 14 must be positioned beneath and offset to the pouring side of the bottle 24, as shown in solid line in FIG. 4. As the bottle empties, the receiving ladle 14 is moved closer to the car until it may actually be positioned (shown in phantom) directly beneath the car. Once the receiving ladle has been filled it is moved along a track 52 away from the station 30. The receiving ladle 14 includes two stub shaft journals 54 to allow a crane with a specially constructed hoist to lift the ladle from its platform car 16 and carry it from the station.

The present invention allows the molten iron and slag material in the bottle to be readily separated. The slag material is lighter than the molten iron and therefore floats on it. By carefully pouring the molten iron from the spout 29 into the receiving ladle it is possible to avoid dispensing the slag material along with the iron. Once all usable molten iron is poured, the bottle is rotated back to its initial position and the receiving ladle 14 is removed from the receiving pit. A slag ladle or pot is then positioned beneath the bottle car and the slag material poured into it for removal to a slag pit. Any slag material that may be poured from the bottle into the receiving ladle 14 can be subsequently separated from the usable iron by using a slag raking device or by substituting a slag dam ladle for the conventional receiving ladle.

An alternative embodiment of the invention includes a movable track section 32 with a range of travel that allows it to be moved to either side of the bottle car at the pouring and dekishing station. In this embodiment the bottle 24 is rotated in a first direction to pour usable iron into a receiving ladle positioned beneath the bottle car adjacent the side opposite from that to which the track section was moved. Once all usable iron has been poured, the movable track section is moved to the opposite side of the car. The bottle is then rotated in an opposite direction about its horizontal axis 28 to pour slag material into a slag pot beneath and adjacent that side of the car. In each pouring operation, the bottle is rotated to an extent that the path of the contents being poured passes through the area that would have been occupied by the track section if not moved out of alignment to the opposite side of the car. In this embodiment of the invention receiving pit 33 is further elongated in the direction of the end wall 46 to make room for the slag pot and the maintenance platform 56 (FIG. 4) is removed.

It should be apparent to those skilled in the art that while the invention has been described with a degree of particularity certain modifications or alterations could be made in the disclosed apparatus without departing from the spirit or the scope of the invention defined in the appended claims.

We claim:

1. A method of pouring iron or slag or both from a railroad bottle car in which a bottle that contains molten iron is supported by spaced trucks on an extending track and is rotatable about a horizontal longitudinal axis to pour contents from an opening located between said trucks into a first vessel located below the car and track, said method comprising the steps of:

positioning the car on the track and the vessel below the track so the trucks are spaced on opposite sides of the vessel and the bottle opening is in alignment with the vessel in the direction of the extending track, moving a section of the track between the trucks in a direction transversely of the extending track to a location to one side of the car, and rotating the bottle about said axis to move the opening from a position adjacent the top of the bottle toward the bottom in a direction away from the side to which the track section was moved, to pour at least a portion of the contents into said first vessel in a path that passes through an area where the track section was located prior to being moved.

2. The method as set forth in claim 1 including the step of moving the vessel transversely of the extending track from a location to one side of the car to a location substantially beneath the car while the bottle is rotated.

3. The method as set forth in claim 1 including the steps of locating a second vessel below the car aligned transversely of the track with the first vessel, the first vessel being offset to one side from said longitudinal axis and the second vessel being offset to the other side, and after the first said rotating step, moving the track section in a direction transversely of the extending track from said one side of the car to a location on the other side of the car and rotating the bottle in an opposite direction to pour at least a portion of the remaining contents into said second vessel in a path that passes through an area where the track section was located prior to being moved.

4. The method as set forth in claim 3 including the subsequent steps of moving the track section into alignment with the extending track and thereafter moving the bottle car from its position on the track.

5. The method as set forth in claim 1, 2 or 3 including the step of temporarily preventing movement of the bottle car along the extending track when the track section is moved.

6. A method for transferring molten metal from a track supported container that includes a dispensing opening, comprising the steps of:

(a) moving the container along a supporting track to a location above a vessel-receiving space, said track providing two locations of support, one location on either side of the space;

(b) removing a section of the track beneath the container and between the two support locations;

(c) rotating the container to cause molten metal to flow through the dispensing opening into a vessel in the space, while the section is removed, and (d) returning the section to a position beneath the container.

7. The method of claim 6 wherein the track section is supported for movement in two directions and the section is moved in one direction before molten metal is poured from the container and moved in another direction before slag material is poured from the container into a second vessel.

8. Apparatus for facilitating pouring of iron or slag or both from a railroad bottle car that has supporting wheels at opposite ends and a central space therebetween aand a bottle supported at opposite ends over the wheels for rotation about a horizontal longitudinal axis, the bottle having an opening located within the central space, said apparatus comprising:

a track for supporting a bottle car and extending above an area in which a vessel can be located below the track for receiving contents of the car, means supporting a section of the track for movement transversely of the extent of the track, the section being shorter than said central space, said supporting means comprising a second track extending transversely beneath said section and a wheeled carriage riding on said second track and supporting said section, and motor means for reciprocating said carriage along the second track between a first location aligned with said extending track and a second location offset to one side thereof.

9. Apparatus set forth in claim 8 further including a first vessel located in said area below the extending track and adjacent said central space where it can receive contents from said car dispensed in a path that passes through said first location.

10. Apparatus as set forth in claim 9 including means to move said first vessel in a direction transversely of the extending track while contents is poured from said car.

11. Apparatus as set forth in claim 9 wherein said first vessel is located at least partially to one side of the extending track, and including a second vessel in said area below the extending track and at least partially offset to the other side thereof adjacent the central space where it can receive contents from said car dispensed in a path that passes through said first location.

12. Apparatus as set forth in claim 8 or 9 including means connected with said track for selectively preventing movement of said car when the section is moved transversely of the extent of the track.

13. Apparatus for transferring molten metal from a railroad car that includes a rotatably mounted container with a dispensing opening, comprising:

(a) track transfer means for removing a section of railroad track from beneath the container;

(b) means for rotating the container about an axis parallel to the tracks for pouring contents through the opening into a vessel positioned below the railroad car; and (c) car retainer means for preventing movement of the car during rotation of the container

14. The apparatus of claim 13 wherein the track transfer means comprise a motor coupled to the section operable to move the section along a horizontal path transversely of the tracks to either side of the tracks to facilitate pouring from the container in opposite directions.

* * * * *